US008217865B2

(12) United States Patent
Tada et al.

(10) Patent No.: US 8,217,865 B2
(45) Date of Patent: Jul. 10, 2012

(54) DISPLAY APPARATUS AND DRIVING METHOD FOR THE SAME

(75) Inventors: Mitsuru Tada, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 1084 days.

(21) Appl. No.: 11/175,369

(22) Filed: Jul. 7, 2005

(65) Prior Publication Data

US 2006/0017394 A1 Jan. 26, 2006

(30) Foreign Application Priority Data

Jul. 23, 2004 (JP) ..... P2004-215086

(51) Int. Cl.
*G09G 3/30* (2006.01)
*G05G 5/10* (2006.01)

(52) U.S. Cl. ..... 345/77; 345/691; 345/82

(58) Field of Classification Search ..... 345/76–77, 345/82–83, 60, 63, 204, 690–691
See application file for complete search history.

(56) References Cited

U.S. PATENT DOCUMENTS

| | | | | |
|---|---|---|---|---|
| 7,477,248 | B2 * | 1/2009 | Johnson | 345/214 |
| 2003/0218583 | A1 * | 11/2003 | Hasagawa | 345/76 |
| 2004/0026723 | A1 * | 2/2004 | Miyazawa | 257/277 |
| 2004/0052076 | A1 * | 3/2004 | Mueller et al. | 362/293 |
| 2004/0169622 | A1 * | 9/2004 | Matsuura et al. | 345/76 |
| 2004/0178974 | A1 * | 9/2004 | Miller et al. | 345/82 |
| 2005/0083268 | A1 * | 4/2005 | Mori et al. | 345/76 |
| 2006/0152452 | A1 * | 7/2006 | Hoppenbrouwers et al. | 345/77 |

FOREIGN PATENT DOCUMENTS

| | | | |
|---|---|---|---|
| JP | 07-036410 | | 2/1995 |
| JP | 08-248934 | | 9/1996 |
| JP | 2000-356981 | | 12/2000 |
| JP | 2002-169509 | | 6/2002 |
| JP | 2003-122305 | | 4/2003 |
| JP | 2003-150110 | | 5/2003 |
| JP | 2003-195816 | | 7/2003 |
| JP | 2003-255895 | | 9/2003 |
| JP | 2003-330421 | A | 11/2003 |
| JP | 2005-227543 | A | 8/2005 |
| WO | WO-03/091979 | A1 | 11/2003 |

* cited by examiner

*Primary Examiner* — Amr Awad
*Assistant Examiner* — Stephen A Bray
(74) *Attorney, Agent, or Firm* — Rader Fishman & Grauer, PLLC

(57) ABSTRACT

A display apparatus includes a pixel array, a life control unit, a signal output unit, and a duty ratio transmission unit. The pixel array, including light-emitting elements constituting a screen, displays each frame of an image on the screen by emitting light having a luminance in accordance with a level of an image signal and continuously emits light from the screen within each frame for an amount of time specified by a duty ratio. The life control unit extends the life of the light-emitting elements by simultaneously adjusting the maximum permissible level of the image signal and the duty ratio. The signal output unit drives the screen to display an image by outputting an image signal adjusted within the maximum permissible level to the pixel array. The duty ratio transmission unit for enabling the screen to emit light for an amount of time specified transmitting an adjusted duty ratio to the pixel array.

16 Claims, 11 Drawing Sheets

DISPLAY APPARATUS AND DRIVING METHOD FOR THE SAME

CROSS REFERENCES TO RELATED APPLICATIONS

The present invention contains subject matter related to Japanese Patent Application JP 2004-215086 filed in the Japanese Patent Office on Jul. 23, 2004, the entire contents of which are incorporated herein by reference.

BACKGROUND OF THE INVENTION

1. Field of the Invention

The present invention relates to a flat display apparatus including a screen constituted of a group of light-emitting elements, such as organic electroluminescent (EL) elements. More specifically, the present invention relates to a technology for extending the light emission life of the light-emitting elements by suppressing degradation that occurs over time by improving the circuitry of the light-emitting elements.

2. Description of the Related Art

A popular flat panel display apparatus under development, such as an organic electroluminescent (EL) display, is constituted of pixels including light-emitting elements. An organic EL display is capable of displaying high-quality images having a wide viewing angle, a high-speed response, a wide range of color reproducibility, and high contrast. An organic EL display has a thin panel. These features of an organic EL display fulfill the demands placed on next-generation flat panel displays following liquid crystal displays and plasma displays.

It is known that light-emitting elements included in the pixels of an organic EL display degrade in accordance with the cumulative amount of light the light-emitting elements emit. In other words, the luminance of the light-emitting elements decreases over time. Extending the lifetime of a light-emitting element is a great challenge to be faced in developing organic EL displays.

At present, to use an organic EL display, for example, as a monitor for a television set, the light emission life of the light-emitting elements must be extended. However, the development of organic EL materials used for organic EL light-emitting elements require enormous time and cost. For this reason, the light emission life of light-emitting elements has not been extended dramatically. To develop an organic EL display that can be put to practical use in the near future, it is necessary to extend the light emission life of light-emitting elements to a practical level by providing an improved driving method of the light-emitting elements in addition to extending the light emission life of the light-emitting elements by developing new materials.

Technologies for extending the life of an organic EL display by improving the circuitry are disclosed, for example, in the following documents:

Japanese Unexamined Patent Application Publication Nos. 07-036410, 2003-150110, 2002-169509, 08-248934, 2000-356981, 2003-195816, 2003-122305, and 2003-255895.

Similar to a cathode-ray tune (CRT) display, the user is capable of controlling the luminance of the screen and the contrast of an organic EL display. More specifically, the luminance of the screen can be controlled by changing the duty ratio. The duty ratio is a value specifying the proportion of the light-emitting time of a light-emitting element in one frame period. The life of a light-emitting element is extended by applying duty control in Japanese Unexamined Patent Application Publication Nos. 2003-195816 and 2003-122305. By controlling the duty ratio, the life of the light-emitting element can be extended by shortening the light-emitting time of the light-emitting element when an image of a frame is bright and the life of the light-emitting element can be extended by extending the light-emitting time of the light-emitting element when an image of a frame is dark. According to such known methods, only the duty ratio is controlled, and the life of a light-emitting material can only be extended by controlling the light-emitting time of the light-emitting element by only controlling the duty ratio. Therefore, the life of the light-emitting element has not been extended to a practical level.

According to Japanese Unexamined Patent Application Publication No. 07-036410, the amount of change in a driving voltage of a light-emitting element is detected and a constant current signal is controlled in accordance with the amount of change. According to Japanese Unexamined Patent Application Publication No. 2003-150110, a reverse bias is applied while an EL element is not illuminating so as to prevent degradation of the EL element. According to Japanese Unexamined Patent Application Publication No. 2003-255895, a reverse bias is applied to an EL element in synchronization with the driving of the EL element such as writing-in, emitting, and deleting an image signal so as to extend the life of the EL element. According to Japanese Unexamined Patent Application Publication No. 2002-169509, degradation of a light-emitting element is prevented by reducing the amount of unnecessary light-emitting time by using a pixel circuit that is capable of actively discharging the retention volume of the pixel. According to Japanese Unexamined Patent Application Publication No. 08-248934, burn-in, which is a type of degradation, is prevented by slightly displacing the display position of a screen for each frame so that one area is illuminated for a long period of time. According to Japanese Unexamined Patent Application Publication No. 2000-356981, the speed of degradation of a light-emitting element is reduced by decreasing the luminance of the light-emitting element based on degradation calculations based on a measurement of the amount of time an image is displayed on a display unit.

SUMMARY OF THE INVENTION

The technologies for improving the lifetime according to the above-described documents have not yet been put to practical use and must be improved more. A flat display apparatus according to an embodiment of the present invention has taken into consideration the above-described problems of known display apparatuses and is capable of extending the life of pixels of light-emitting elements constituting the display apparatus by improving the circuitry. The life of light-emitting elements is extended as described below. The display apparatus according to an embodiment of the present invention includes a pixel array, a life control unit, a signal output unit, and a duty ratio transmission unit. The pixel array includes a plurality of pixels of light-emitting elements constituting a screen. The pixel array is configured to display each frame of an image on the screen by emitting light having a luminance in accordance with the level of an image signal and to continuously emit light from the screen within each frame for an amount of time specified by a duty ratio. The life control unit is configured to extend the life of the light-emitting elements by simultaneously adjusting the maximum permissible level of the image signal and the duty ratio. The signal output unit is configured to drive the screen to display an image by outputting an image signal adjusted within the maximum permissible level to the pixel array. The duty ratio transmission unit is configured to enable the screen to emit light for an amount of time specified by transmitting an adjusted duty ratio to the pixel array.

The life control unit automatically adjusts the maximum permissible level and the duty ratio in accordance with the input image in real time. The life control unit detects the average luminance of the image from the input image signal. The duty ratio specifying the light emission time per frame and the maximum permissible level of the image signal is reduced in inverse proportion to changes in the detected average luminance.

A method for driving a display apparatus according to an embodiment of the present invention is described below. The method for driving a display apparatus has a plurality of pixels of light-emitting elements constituting a screen to display each frame of an image on the screen by emitting light having a luminance in accordance with a level of an image signal and to continuously emit light from the screen within each frame for an amount of time specified by a duty ratio. The method includes the steps of extending the life of the light-emitting elements by simultaneously adjusting the maximum permissible level of the image signal and the duty ratio, displaying an image by outputting an image signal adjusted within the maximum permissible level to the plurality of pixels, and enabling the screen to emit light for an amount of time specified by transmitting an adjusted duty ratio to the plurality of pixels.

The principle of extending the life of the light-emitting element according to an embodiment of the present invention is to variably suppress the amount of light emitted from the light-emitting element when the amount of light emitted from the light-emitting element per frame is large. When the average luminance of the screen is high, the quality of the image will not be affected even if the amount of light emitted from the light-emitting element is decreased. Therefore, the life of the light-emitting element can be extended by decreasing the amount of light emitted from the light-emitting element.

The amount of light emitted from the light-emitting element per frame is obtained by multiplying the intensity of the emitted light and the amount of time light is emitted. The life of a known light-emitting element has been extended by controlling only the amount of time light is emitted specified by a duty ratio. The intensity of the emitted light depended on the driving current of the light-emitting element and was kept within the maximum permissible level of the image signal. The maximum permissible level for a known light-emitting element has not been controlled.

On the other hand, for the light-emitting element according to an embodiment of the present invention, in addition to the amount of time light is emitted per frame, the intensity of the emitted light is controlled so as to extend the life of the light-emitting element. In other words, when the screen is bright, the amount of time light is emitted per frame and the intensity of the emitted light are both controlled to efficiently extend the life of the light-emitting element. For this reason, the duty ratio specifying the amount of time light is emitted per frame and the maximum permissible level of the image signal are reduced more as the average luminance of the screen increases. The intensity of the emitted light has a greater effect on the life of the light-emitting element than the amount of time light is emitted. Hence, for the light-emitting element according to an embodiment of the present invention, to suppress the amount of light emitted, unlike a known light-emitting element, both the amount of time light is emitted and the intensity of the emitted light are reduced. In this way, the life of the light-emitting element is extended while the effect of the amount of time the light is emitted is reduced and the effect of the intensity of the emitted light is increased.

The life control function according to an embodiment of the present invention may be included in a display apparatus by including the life control function in an integrated circuit (IC) of, for example, a timing generator constituting a part of a system. In this way, the life control function according to an embodiment of the present invention can be realized without any special peripheral circuits and without affecting the existing display system. Accordingly, the life of the light-emitting element can be significantly improved by a relatively small change in the circuitry.

DESCRIPTION OF THE PREFERRED EMBODIMENTS

Figure 1:
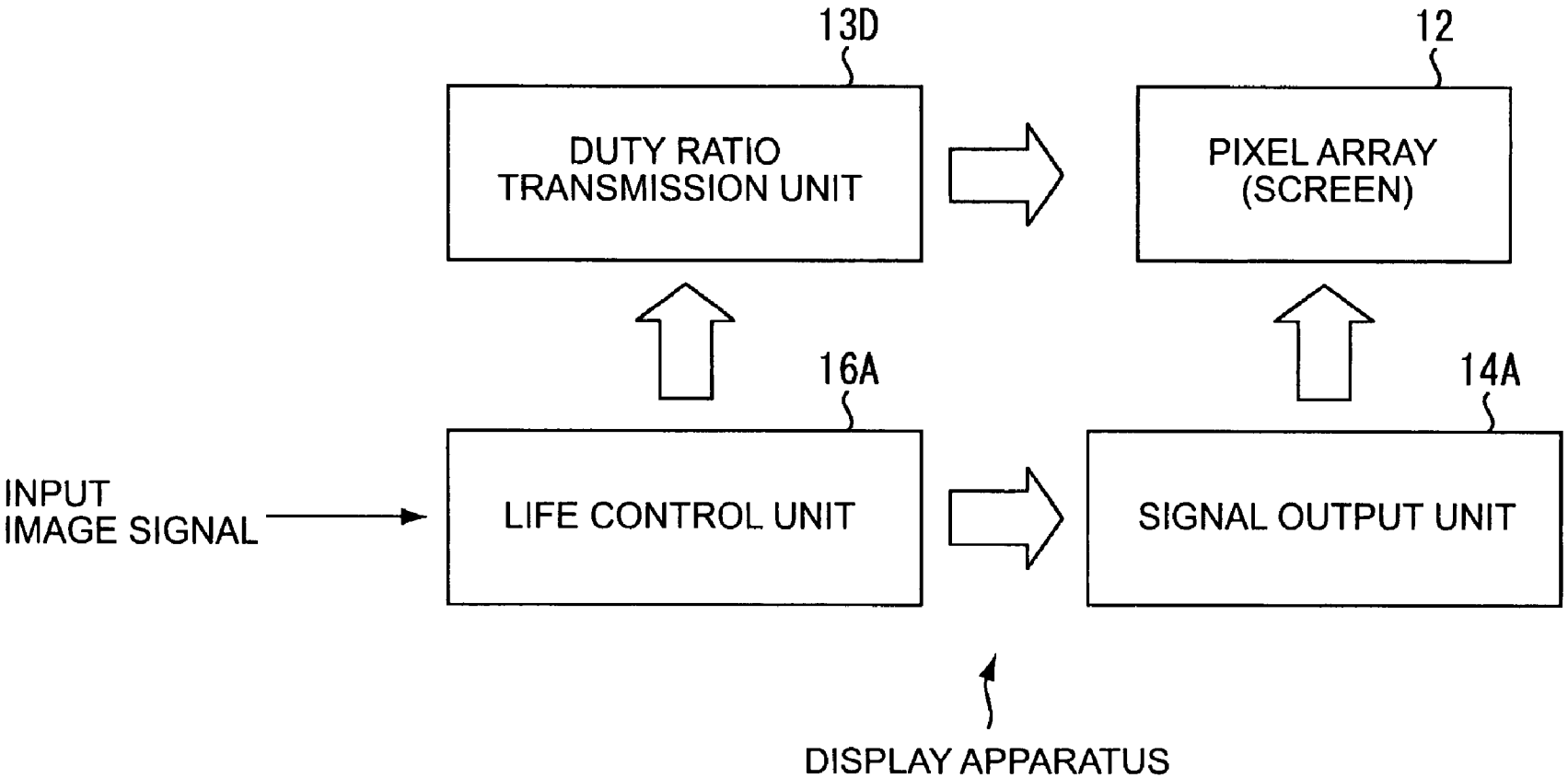
FIG. 1 is a functional block diagram of a display apparatus according to an embodiment of the present invention.

Embodiments of the present invention will be described in detail with reference to the drawings. FIG. 1 is a functional block diagram of a display apparatus according to an embodiment of the present invention. As illustrated in the drawing, the display apparatus includes a pixel array 12, a life control unit 16A, a duty ratio transmission unit 13D, and a signal output unit 14A. The pixel array 12 is a screen constituted of a group of pixels including light-emitting elements, such as organic EL elements. The pixel array 12 emits light having luminance in accordance with the level of an image signal so as to display an image for each frame. At the same time, the pixel array 12 continues to emit light from the screen within each frame for an amount of time specified by a duty ratio. The life control unit 16A adjusts the maximum permissible level of an image signal and the duty ratio so as to extend the life of each light-emitting element included in the pixel array 12. The signal output unit 14A drives the screen to display an image by outputting an image signal within the adjusted maximum permissible level of the image signal to the pixel array 12. The duty ratio transmission unit 13D transmits the duty ratio adjusted at the life control unit 16A to the pixel array 12 so as to operate the screen to emit light for a specified amount of time. The life control unit 16A automatically adjusts the maximum permissible level and the duty ratio in real time in accordance with the input image signal. More specifically, the life control unit 16A detects the average luminance of the image (i.e., the average tone of the entire screen) from the input image signal. The duty ratio specifying the light emission time per frame and the maximum permissible level of the image signal is reduced by the life control unit 16A in inverse proportion to changes in the detected average luminance.

Figure 2:
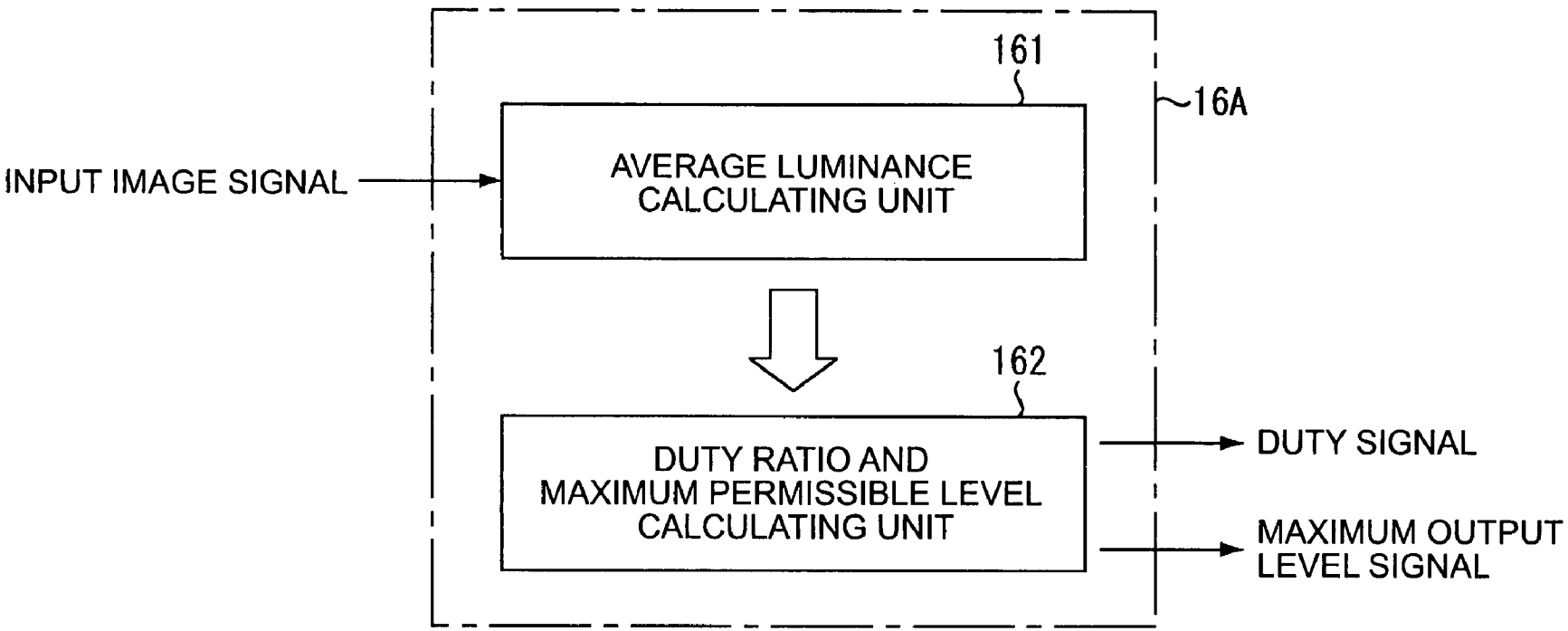
FIG. 2 is a functional diagram of a life control unit illustrated in FIG. 1.

FIG. 2 is a schematic block diagram illustrating the function of the life control unit 16A illustrated in FIG. 1. As illustrated in the drawing, the life control unit 16A includes an average luminance calculation unit 161 and a duty ratio and maximum permissible level calculation unit 162. The average luminance calculation unit 161 calculates the average luminance for each frame by processing the input image signal. The input image signal includes multiple tone data for each pixel. The average luminance is obtained by averaging the multiple tone data per pixel for the entire screen. The duty ratio and maximum permissible level calculation unit 162 calculates the optimum duty ratio for extending the light emission life based on the calculated average luminance. The result of this calculation is supplied to the duty ratio transmission unit 13D as a duty signal. The duty ratio and maximum permissible level calculation unit 162 also calculates the maximum permissible level of the image signal based on the average luminance. The result of this calculation is supplied to the signal output unit 14A as a maximum output level signal. Here, the duty ratio specifying the light emission time per frame and the maximum permissible level of the image signal is reduced by the duty ratio and maximum permissible level calculation unit 162 in inverse proportion to changes in the average luminance.

Figure 3:
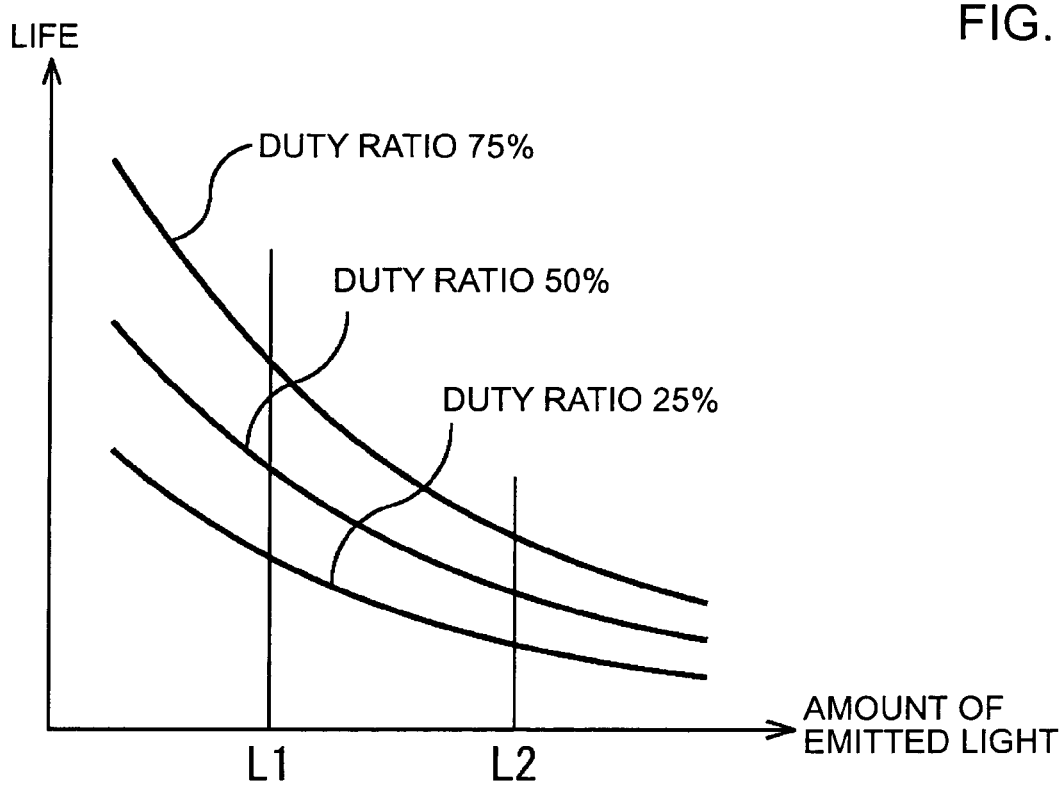
FIG. 3 is a graph accompanying a description of the operation of the life control unit.

Now, the calculation process carried out in the life control unit 16A will be described in detail with reference to FIGS. 3 to 6. FIG. 3 is a graph showing the basic principle of life control processing. In the graph, the vertical axis represents the life of a light-emitting element and the horizontal axis represents the amount of light emitted from the light-emitting element. Three values for the duty ratio are provided as parameters. Here, "duty ratio 75%" means the light is emitted for 75% of the time of a frame and not emitted for the remaining 25% of the time, whereas "duty ratio 25%" means the light is emitted for 25% of the time of a frame and not emitted for the remaining 75% of the time. As is apparent from the graph, for either duty ratio, the life of the light-emitting element is shortened as the amount of light emitted from the light-emitting element increases. By looking at the values for when the amount of light emission is L1, it can be recognized that the higher the duty ratio, the longer the life time. By increasing the duty ratio, the intensity of the emitted light can be reduced because the amount of time light is emitted can be extended. On the contrary, if the duty ratio is decreased, the intensity of the emitted light has to be increased to achieve L1 as the amount of light emission because the amount of time for which light is emitted is shortened. Similarly, even in the case in which the amount of light emission is increased to L2, the life time is longer when the duty ratio is higher. Accordingly, the life of a light-emitting element according to an embodiment is extended based on the principle that reducing the amount of electricity instantaneously supplied to the light-emitting element suppresses the degradation of the light-emitting element. This is true when comparing a case in which the electricity supplied to the light-emitting element is reduced to suppress the intensity of the emitted light and the amount of time light emitted per frame is extended with a case in which the electricity supplied to the light-emitting element is increased to increase the intensity of the emitted light and the amount of time light is emitted per frame is shortened. The duty ratio and the maximum permissible level of the image signal are adaptively controlled based on this principle.

Figure 4:
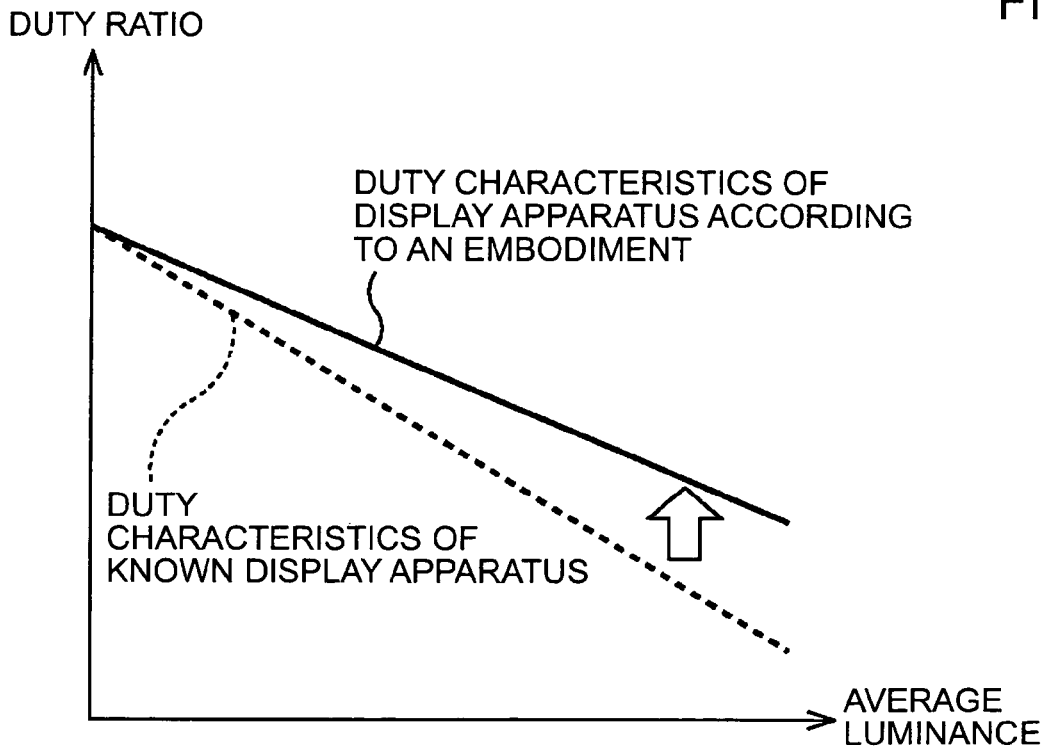
FIG. 4 is a graph accompanying a description of the operation of the life control unit.

FIG. 4 is a graph showing the relationship between the average luminance of the screen (average tone) and the duty ratio adjusted by the life control unit 16A. For comparison, the duty characteristics for the display apparatus according to an embodiment of the present invention and the duty characteristics for a known display apparatus are plotted on the graph. In either case, the life of the light-emitting elements is extended by suppressing the amount of light emitted from the light-emitting elements by reducing the duty ratio as the average luminance of the screen increases. When the entire screen is bright, the quality of the image displayed on the screen is not degraded even when the luminance is reduced. Therefore, when the screen is bright, the luminance can be reduced to extend the life of the light-emitting elements of the screen. As shown in the graph, the line representing the reduction in the duty ratio of the display apparatus according to an embodiment of the present invention has a gentle slope compared to the duty ratio of a known display apparatus. The line representing the duty characteristics of the display apparatus according to an embodiment of the present invention is a straight line. However, the line representing the duty characteristics is not limited, and an optimum duty characteristics line may be selected in accordance with the characteristics of the device.

Figure 5:
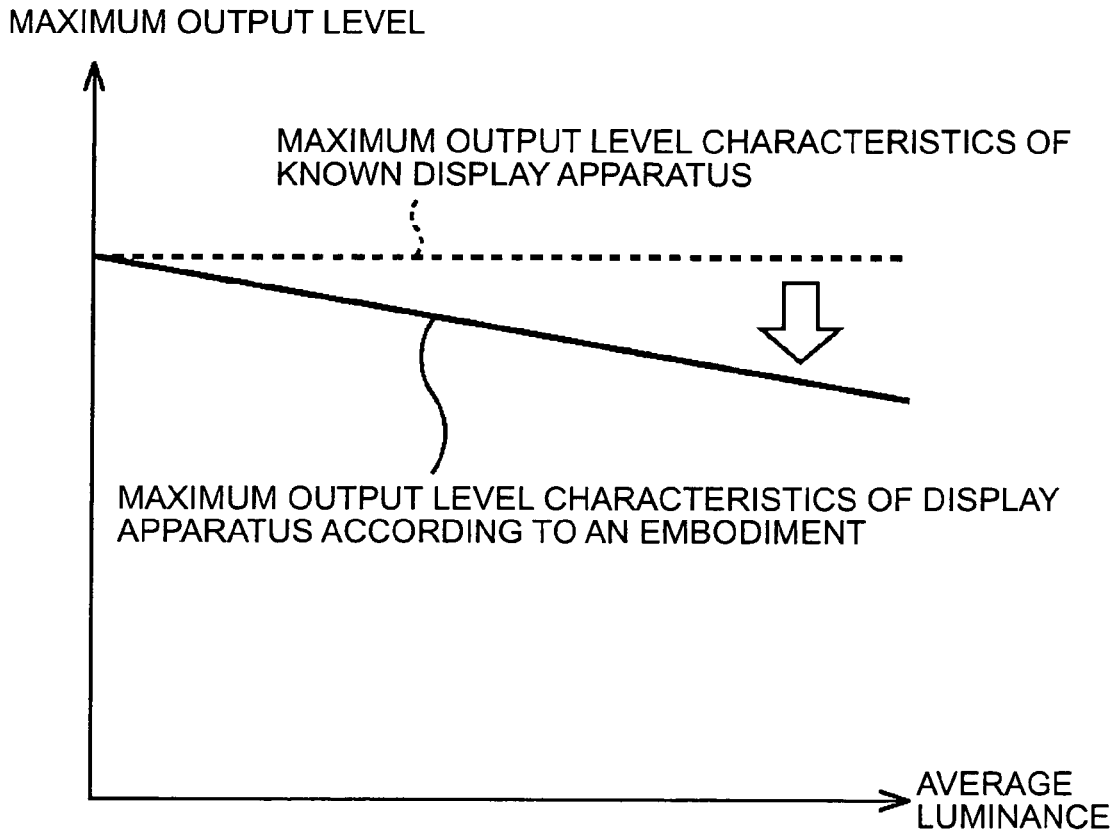
FIG. 5 is a graph accompanying a description of the operation of the life control unit.

FIG. 5 is a graph showing the relationship between the average luminance of the screen (average tone) and the maximum output level (maximum permissible level) of the image signal adjusted by the life control unit 16A. For comparison, the maximum output level for the display apparatus according to an embodiment of the present invention and the maximum output level for a known display apparatus are plotted on the graph. As shown in the graph, the maximum output level of the known display apparatus is fixed. In other words, for the known display apparatus, the contrast was constant regardless of the luminance of the screen. Therefore, in order to extend the life of the light-emitting elements, only the duty ratio is modified. On the other hand, for the display apparatus according to an embodiment of the present invention, the more the average luminance of the screen increases, the more the maximum output level is reduced. In this way, the amount of the emitted light is suppressed and the life of the light-emitting element is extended. When the entire screen is bright, the quality of the image displayed on the screen is not affected even when the contrast is somewhat reduced. By reducing the contrast, the life of the light-emitting element can be extended. For a known display apparatus, the life of the light-emitting elements is extended by reducing the amount of the emitted light by suppressing the light emission time when the screen is bright, whereas, for the display apparatus according to an embodiment of the present invention, the life of the light-emitting elements is extended by reducing the amount of the emitted light by suppressing both the light emission time and the intensity of the emitted light when the screen is bright. When the amount of the emitted light is the same, it is more effective to reduce the intensity of the emitted light than reducing the light emission time. The line representing the maximum output level is a straight line for the display apparatus according to an embodiment of the present invention. However, the maximum output level is not limited and may be represented by a curved line.

Figure 6:
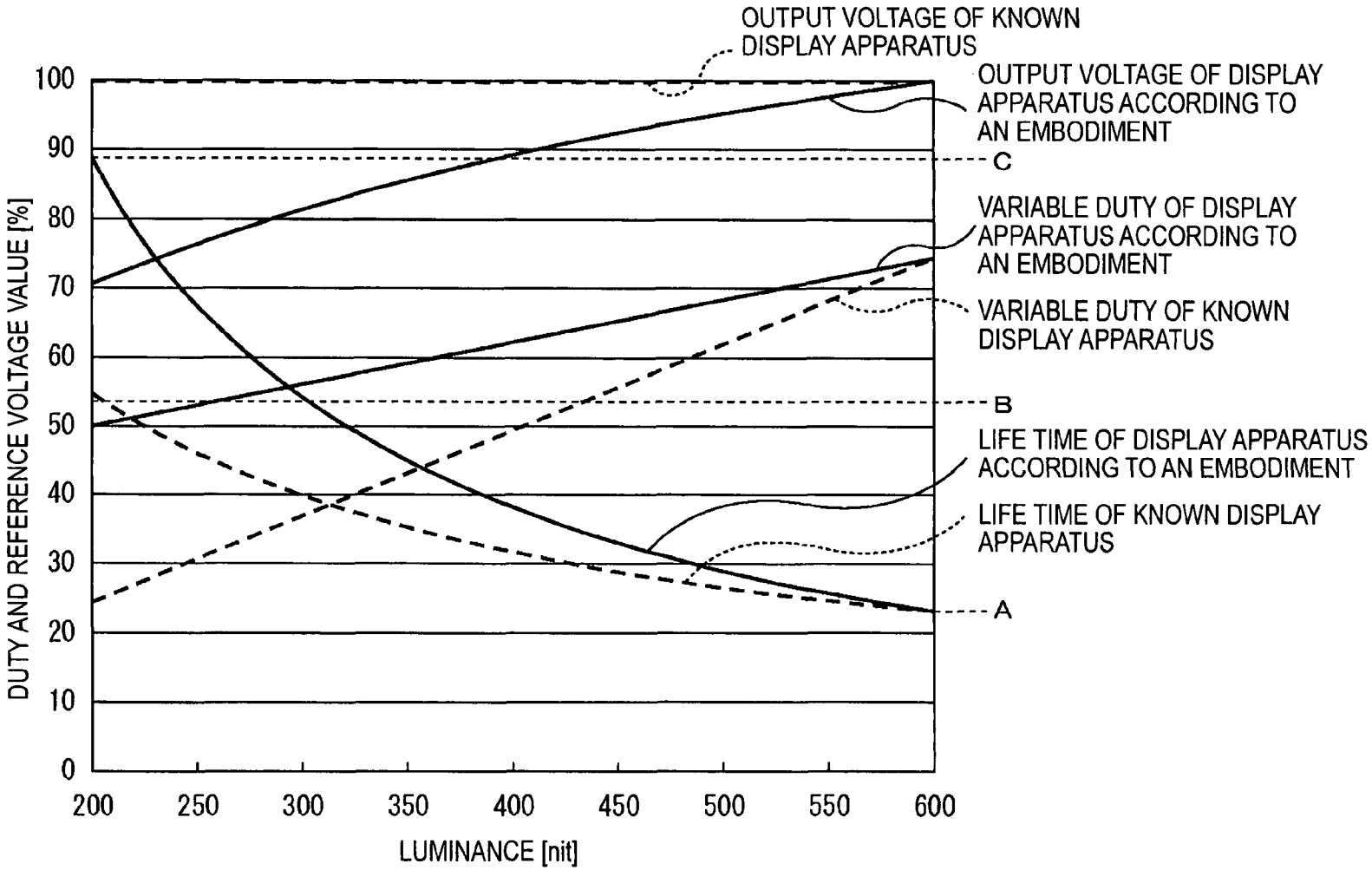
FIG. 6 is a graph accompanying a description of the operation of the life control unit.

FIG. 6 is a graph showing the relationship between the duty signal, the output voltage, and the life characteristics of the light-emitting element material for when the output luminance is changed from 200 nit to 600 nit according to a change in the signal tone average value. In the graph, the information on the output data maximum value is represented as an output voltage if the driving method for writing data in the display apparatus is based on voltage. If the driving method for writing data in the display apparatus is based on electrical current, the information on the output data maximum value is represented as a current value. Since this technology is based on changing the maximum current supplied to the organic EL material constituting the light-emitting elements, differences in the signal voltage and the signal current in the pixel circuits do not affect the technology.

The graph in FIG. 6 shows an exemplary characteristics line. To change the luminance from 200 nit to 600 nit for a known display apparatus, the luminance was changed by only using the line representing variable duty. Consequently, the life of the light-emitting elements was merely extended from level A to level B. On the other hand, in the display apparatus according to an embodiment of the present invention, the light emission time of the light-emitting element emitting light was extended, compared to light emission time of a known display apparatus, based on the duty signal. Since the light emission time was extended, the intensity of the emitted light was reduced by suppressing the output voltage of the data. In this way, the life of the light-emitting elements was significantly extended from level A to level C.

Figure 7:
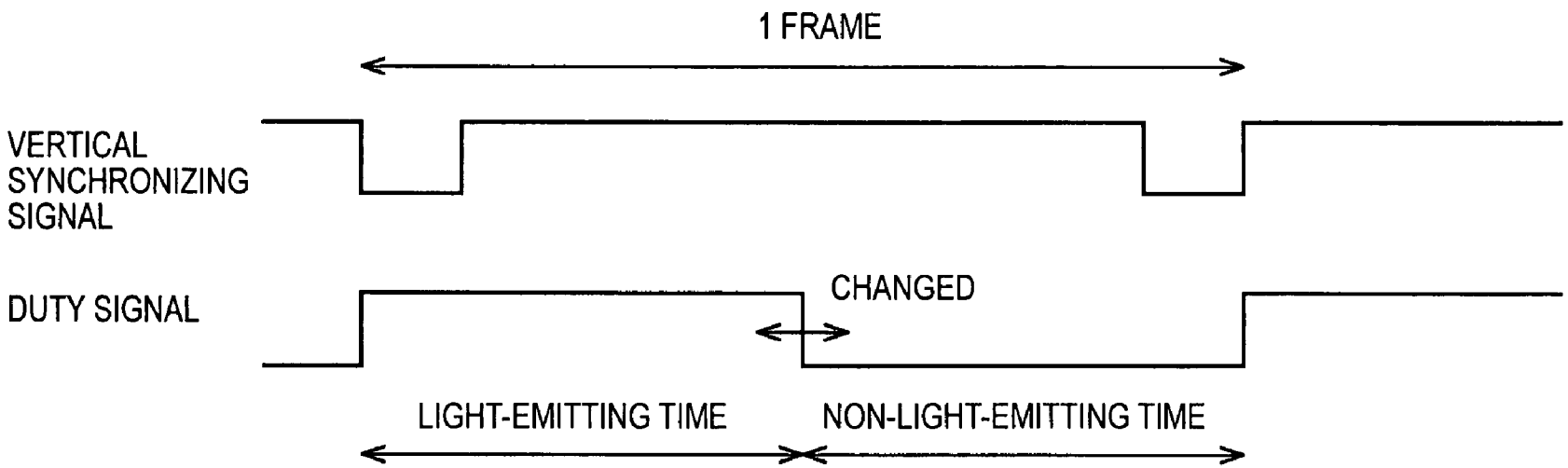
FIG. 7 is a timing chart accompanying a description of the operation of a duty ratio transmission unit illustrated in FIG. 1.

The operation of the duty ratio transmission unit 13D, illustrated in FIG. 1, will be described with reference to FIG. 7. As described above, the duty ratio transmission unit 13D converts the duty signal input from the life control unit 16A to the pixel array 12 of the screens into a pulse for controlling the light emission time of the light-emitting element and then outputs this pulse. FIG. 7 illustrates a vertical synchronizing signal and a duty signal. The duty ratio transmission unit 13D includes a shift resistor and outputs a pulse for controlling the light emission time for each line by sending the duty signal in sequence in accordance with the vertical synchronizing signal. A typical organic EL display carries out line-sequential scanning. In line-sequential scanning, data are displayed in line units. By turning on and off a pulse for driving a line, as illustrated in the drawing, within a frame time period, the light emission time for each line can be controlled. By scanning the pulse for each line, the light emission time of the entire screen is controlled by a single signal. In other words, the duty ratio represents the proportion of the light emission time in one vertical time period (1 frame period). In the timing chart illustrated in FIG. 7, light is emitted from the light-emitting element when the duty signal is at a high level, and light is not emitted from the light-emitting element when the duty signal is at a low level. By changing the time width of the pulse of the duty signal, the luminance of the screen can be adjusted.

Figure 8:
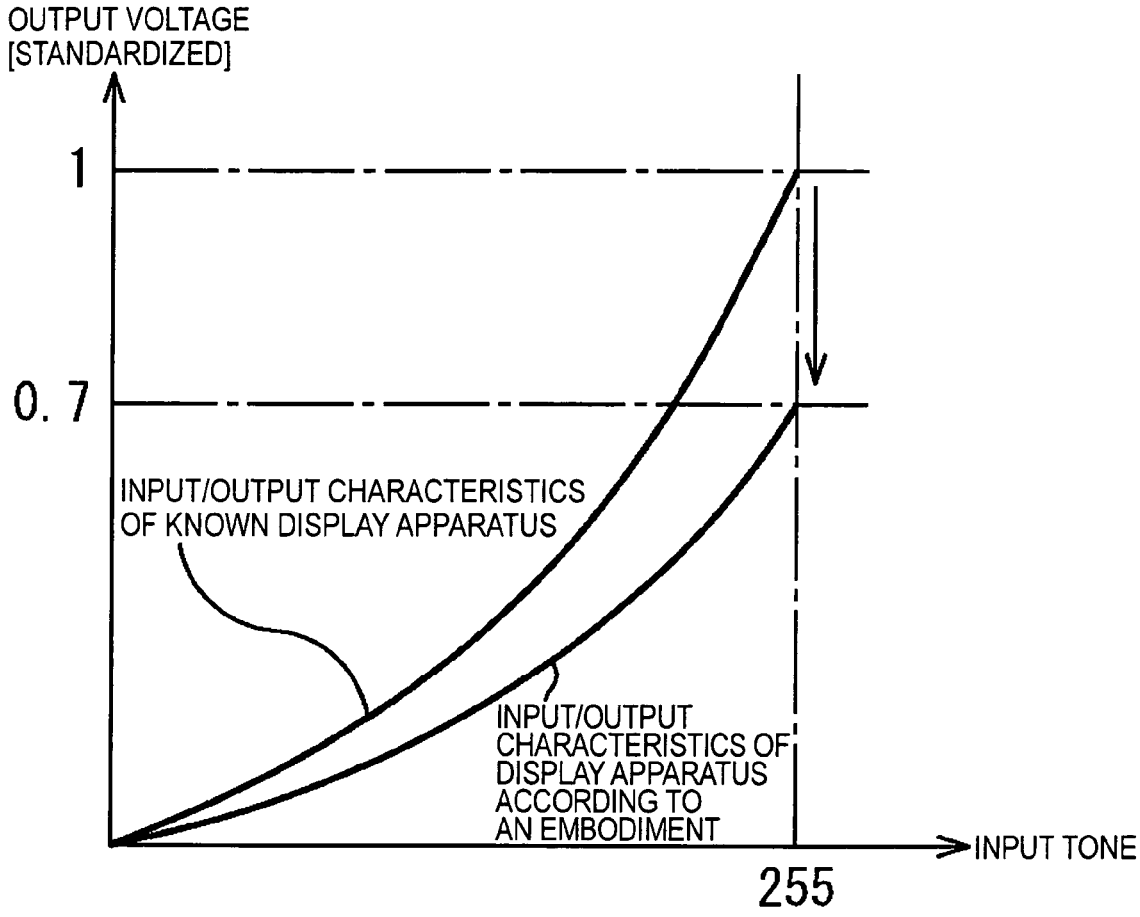
FIG. 8 is a graph accompanying a description of the operation of a signal output unit illustrated in FIG. 1.

Next, the operation of the signal output unit 14A, illustrated in FIG. 1, will be described with reference to the FIG. 8. The signal output unit 14A includes a digital/analog (D/A) converter for converting the input tone data included in the input image signal into an output voltage. The graph shown in FIG. 8 represents the input-output conversion characteristics of the D/A converter. The signal output unit 14A converts the digital data tone data into an analog signal based on the maximum permissible level of the image signal sent from the life control unit 16A and, then, outputs the converted data to the light-emitting elements. The maximum permissible level of the image signal sent from the life control unit 16A is a limit voltage output when the maximum tone is input during the D/A conversion. The level is changed at the life control unit 16A for each frame, as described above. Furthermore, as described above, when the average luminance of the screen is high, the life control unit 16A reduces the maximum permissible level. As a result, the input-output characteristics of the signal output unit 14A according to an embodiment of the present invention is shifted downwards in comparison with the input-output characteristics of a known signal output unit.

Figure 9:
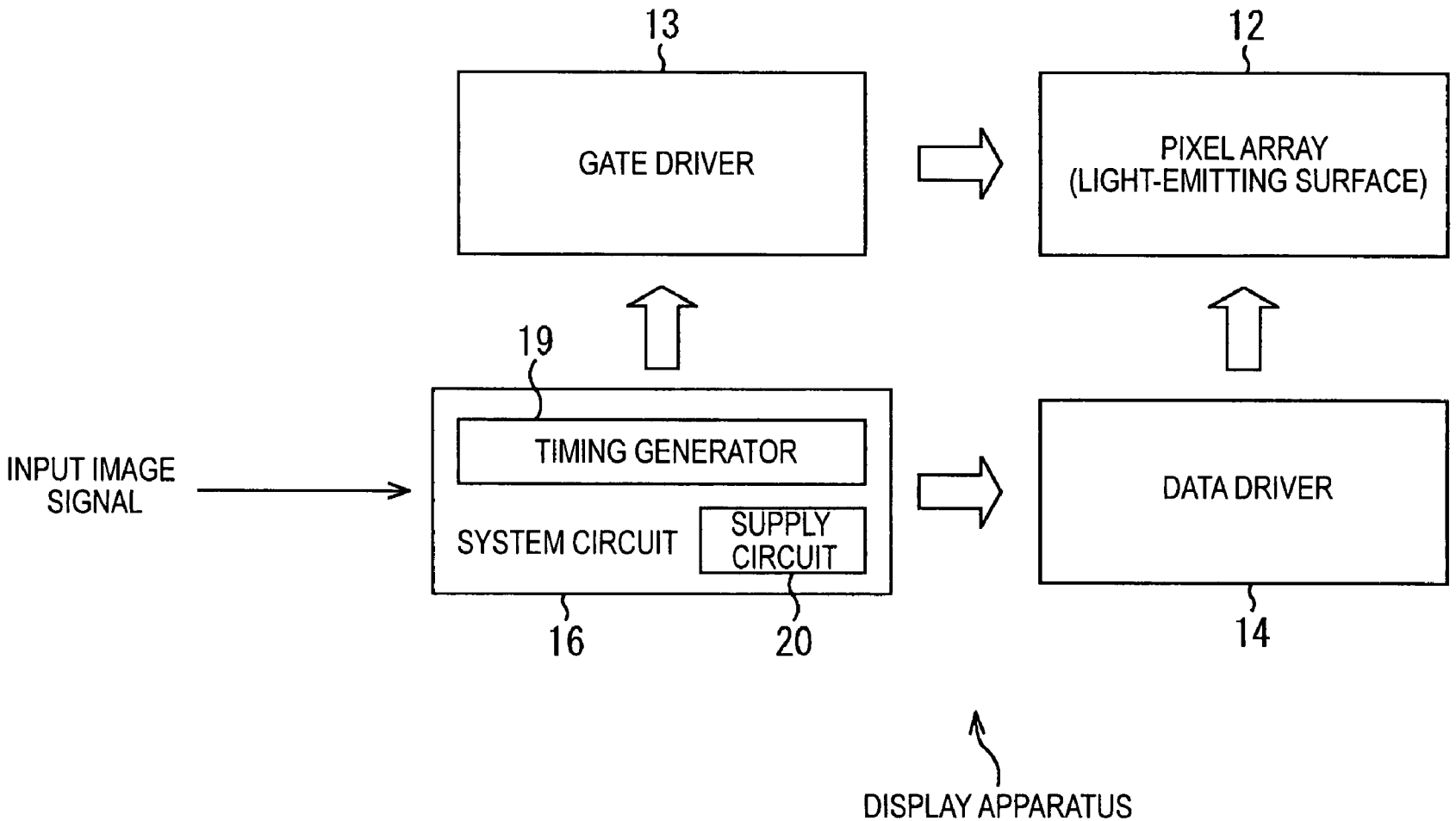
FIG. 9 is a hardware block diagram illustrating the display apparatus illustrated in FIG. 1.

FIG. 9 is a hardware block diagram corresponding to the functional block diagram illustrated in FIG. 1. By comparing FIGS. 1 and 9, it is apparent that the life control unit 16A, which is a main component of the display apparatus according to an embodiment of the present invention, is realized by a system circuit 16. The duty ratio transmission unit 13D is realized by a gate driver 13. The signal output unit 14A is realized by a data driver 14. The system circuit 16 is provided on an external circuit board and includes a timing generator 19 and a supply circuit 20. The timing generator 19 sends an adjusted duty signal to the gate driver 13. The supply circuit 20 sends an adjusted limit voltage to the data driver 14. The gate driver 13 transfers the duty signal input from the system circuit 16 in sequence to drive the scanning lines of the pixel array 12. The data driver 14 converts the digital image signal input from the system circuit 16 to an analog data voltage and supplies this to the data lines of the pixel array 12. The display apparatus illustrated in FIG. 9 is constituted of a typical system circuit 16, a gate driver 13, a data driver 14, and a pixel array 12. The gate driver 13 and the data driver 14 may be mounted on the same panel as the pixel array 12 as a unit. Alternatively, the pixel array 12 may be constituted of a single panel and the gate driver 13 and the data driver 14 may be connected to the panel as external integrated circuits (ICs). The display apparatus according to an embodiment of the present invention can be realized easily by including the function of the life control unit 16A in a system circuit of a known display apparatus. The lifetime of light-emitting elements can be extended by making a relatively small change in the circuitry. By including the functions of the life control unit 16A according to an embodiment of the present invention in an external system circuit IC, the display apparatus according to an embodiment of the present invention can be realized by using a known display system without adding any special peripheral circuits.

Figure 10:
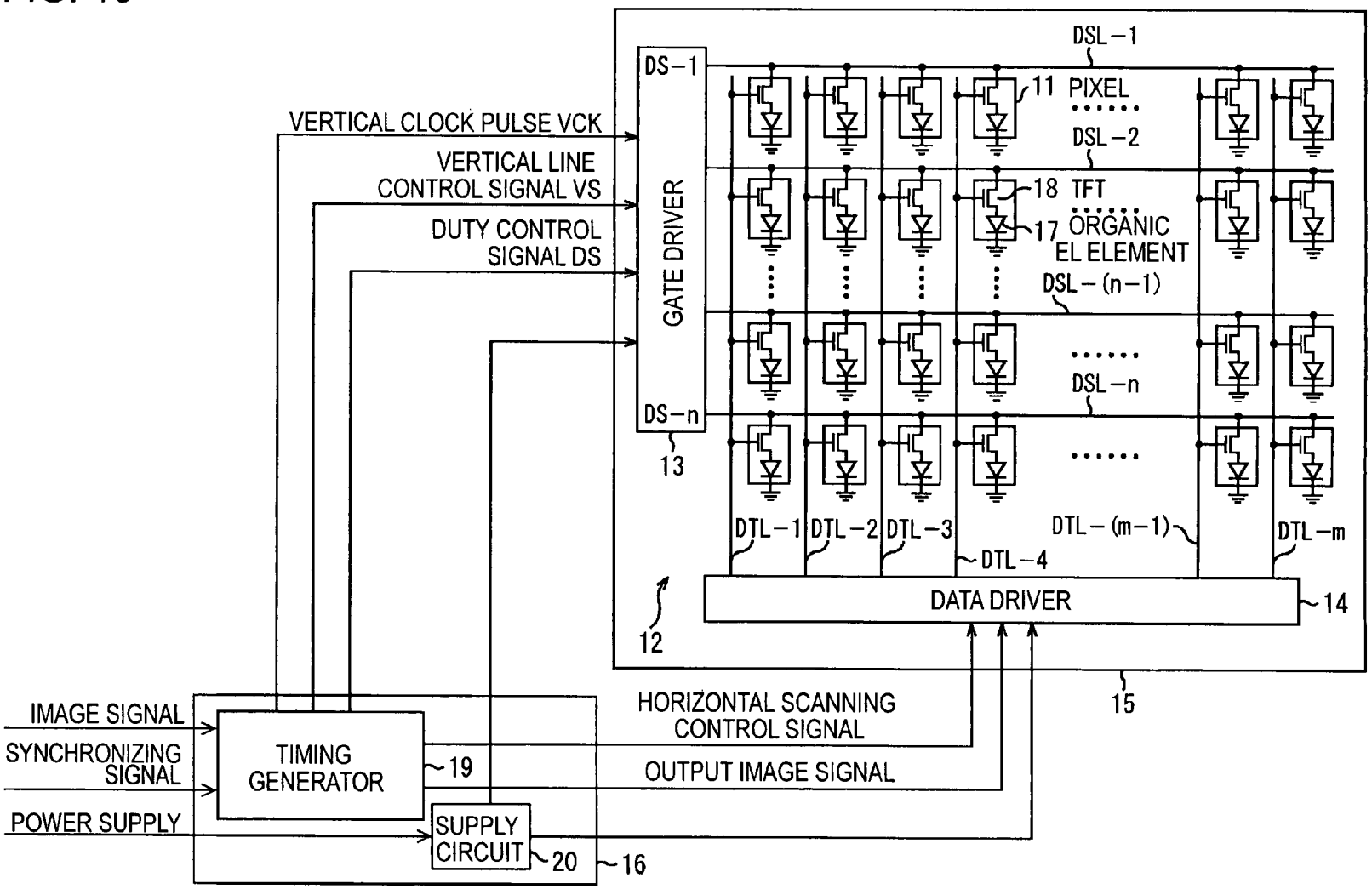
FIG. 10 is a circuit diagram illustrating the detailed structure of the display apparatus illustrated in FIG. 9.

FIG. 10 is a circuit diagram illustrating details of the circuitry of the display apparatus illustrated in FIG. 9. The circuitry, for example, is for an active matrix organic EL display apparatus using organic EL elements, which are self-luminant elements, as display elements for the pixels. The active matrix organic EL display apparatus according to an embodiment of the present invention is constituted of a organic EL panel (substrate) 15 on which a pixel array 12 including pixels 11 arranged in a matrix, a gate driver 13 for driving the pixel array 12, and a data driver 14 are mounted. The active matrix organic EL display apparatus includes a system circuit 16 for driving the gate driver 13 and the data driver 14 outside the organic EL panel 15. In some cases, the gate driver 13 and the data driver 14 are provided as driver ICs separately from the organic EL panel (substrate) 15, and the driver ICs and the panel are connected by tape automated bonding (TAB) or a flexible printed circuit (FPC).

The display apparatus according to an embodiment of the present invention includes the pixel array 12, the data driver 14, the gate driver 13, and the system circuit 16. The pixel array 12 includes horizontal scanning lines DSL, vertical data lines DTL, and pixels 11 arranged in a matrix by being disposed at the intersections of the horizontal scanning lines DSL and vertical data lines DTL. The data driver 14 distributes the image signal supplied from the system circuit 16 to each of the data lines DTL-1 to DTL-m. The gate driver 13 is operated in response to a DS signal supplied from the system circuit 16 and outputs the driving pulses DS-1 to DS-n in sequence to the scanning lines DSL-1 to DSL-n to select the pixels 11 line-sequentially. In this way, the pixels 11 are driven for the time width represented by the driving pulse DS based on the distributed image signal to display an image on the pixel array 12.

The system circuit 16 supplies a start pulse VS (vertical line control signal), a clock signal VCK (vertical clock pulse), and a correction data DS (duty control signal) to the gate driver 13. The system circuit 16 also supplies a horizontal scanning signal and an image signal to the data driver 14.

Each of the components of the display apparatus will be described with reference to FIG. 10. In FIG. 10, each of the pixels 11 includes a field-effect transistor (e.g., polysilicon thin film transistor (TFT)) or an amorphous silicon TFT 18 as an active element driving the light emission of an organic EL element 17. The organic EL elements 17 are disposed on the substrate on which the TFTs 18 are disposed. Each of the organic EL elements 17 is constituted of a plurality of first electrodes including transparent conductive layers on the substrate, an organic layer including a hole transportation layer, a light-emitting layer, an electron transportation layer, and a electron injection layer deposited on the first electrodes, in this order, and a second electrode made of metal deposited on the organic layer. By applying a direct-current voltage between the first and second layers, light is emitted from the light-emitting layer when electrons and holes recombine.

The scanning lines DSL-1 to DSL-n are connected to each horizontal line of the pixel array 12 having an m×n pixel matrix. The data lines DTL-1 to DTL-m are connected to each vertical line of the pixel array 12. One of the ends of the scanning lines DSL-1 to DSL-n is connected to the output end of the horizontal lines of the gate driver 13. The gate driver 13 receives a vertical line control signal VS generated at the system circuit 16, a duty control signal DS for setting the output time, and a power supply for a vertical control signal and outputs vertical control sequential scanning pulses DS-1 to DS-n in synchronization with vertical clock pulses VCK generated at the system circuit 16 to drive the scanning lines DSL-1 to DSL-n.

One of the ends of the data line DTL-1 to DTL-m is connected to the output end of each of the vertical lines of the data driver 14. The data driver 14 has a current write-in driving circuitry or a voltage write-in driving circuitry that writes the luminance information in the pixels 11 via the data lines DTL-1 to DTL-m as current values or voltage values.

The system circuit 16 is provided on an external substrate disposed outside the organic EL panel 15. The system circuit 16 includes the timing generator 19 for controlling the data driver 14 and the gate driver 13 and the supply circuit 20 for setting the level of the image signal output from the data driver 14 at a predetermined voltage.

The timing generator 19 receives an image signal and an synchronizing signal supplied from outside to generates a vertical clock pulse VCK, a vertical control signal VS, and a output-time-setting duty control signal DS for controlling the gate driver 13 and a horizontal scanning control signal and an image signal for controlling the data driver 14 in synchronization with the synchronizing signal. The signals are supplied to the gate driver 13 or the data driver 14, respectively.

Figure 11:
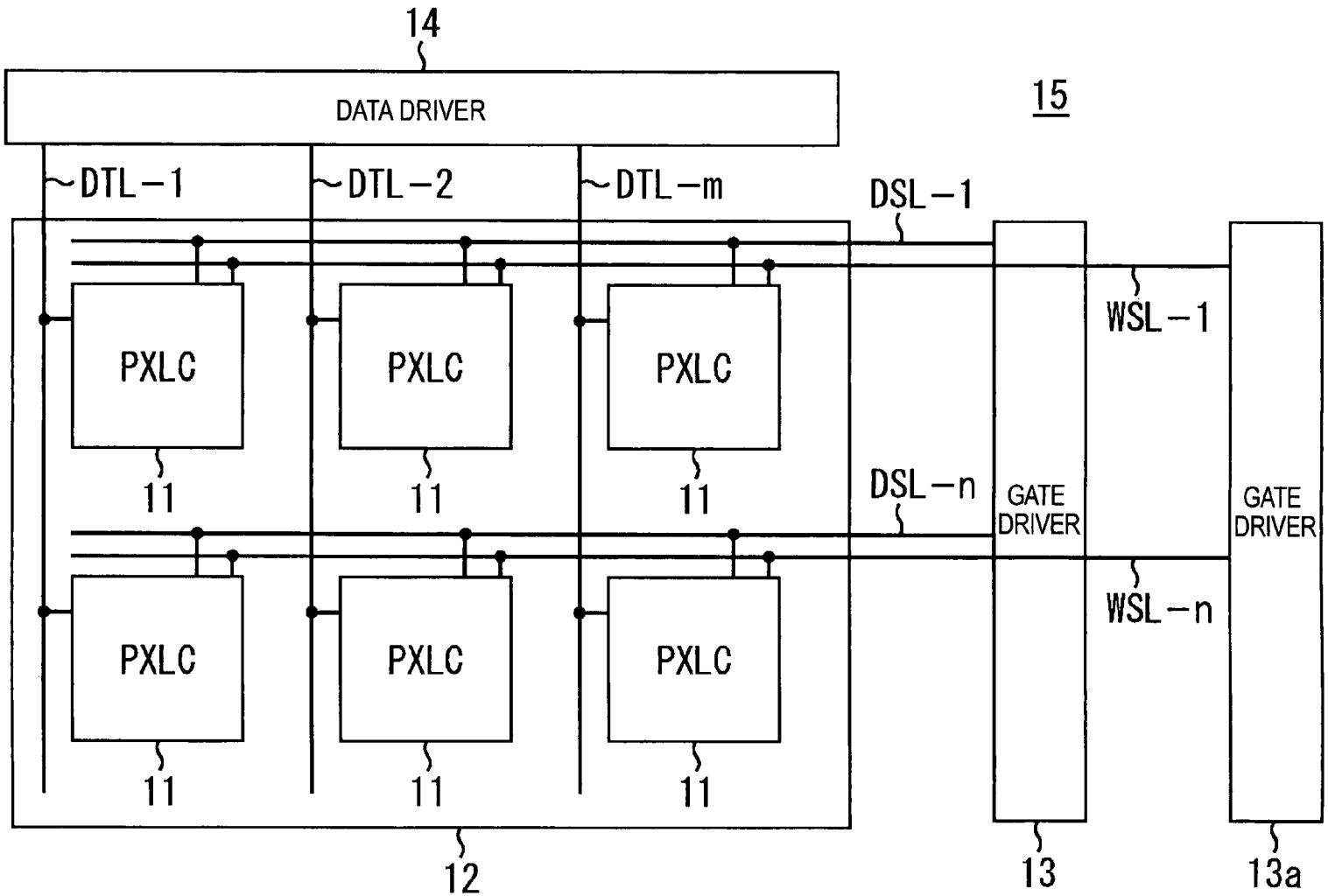
FIG. 11 is a block diagram illustrating the structure of a panel illustrated in FIG. 10.

FIG. 11 is a block diagram illustrating the structure of the organic EL panel 15 illustrated in FIG. 10. The organic EL panel 15 includes the pixel array 12 including a matrix of m×n pixel circuit (PXLC) 11, the data driver 14, the gate driver 13, and an additional gate driver 13*a* making up a part of the gate driver 13, the data lines DTL-1 to DTL-m that are selected by the data driver 14 and receive a signal in accordance with the luminance information, scanning lines WSL-1 to WSL-n selectively driven by the additional gate driver 13*a*, and scanning lines DSL-1 to DSL-n selectively driven by the gate driver 13. The gate driver 13 carries out duty driving, and the gate driver 13*a* drives the write-in of data in the pixels in advance of the duty driving.

Figure 12:
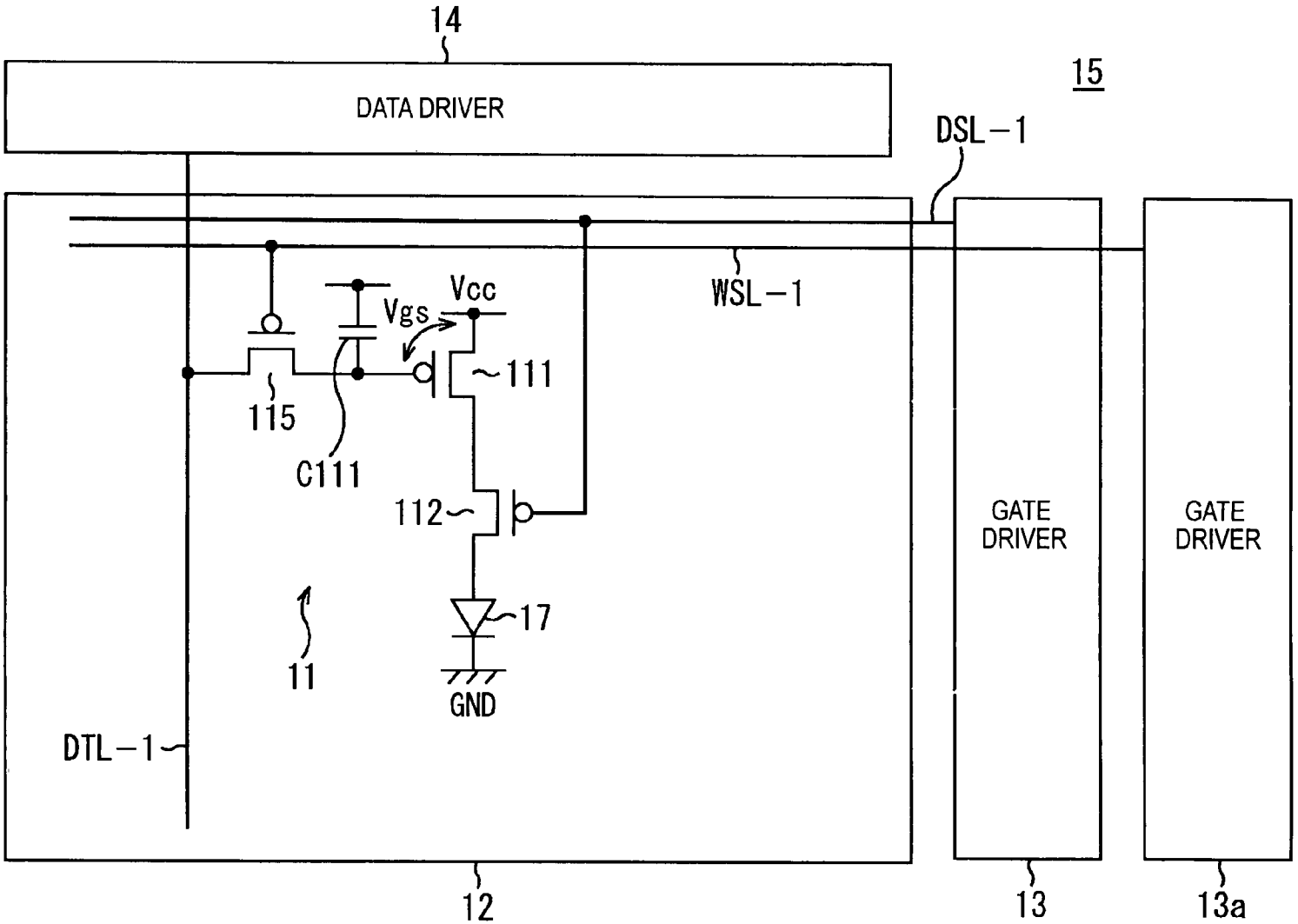
FIG. 12 is circuit diagram illustrating the circuitry of the panel illustrated in FIG. 10.

FIG. 12 is a circuit diagram illustrating the circuitry of the organic EL panel 15 illustrated in FIG. 11. As shown in the drawing, the pixel circuit 11 is constituted of p-channel TFTs. In other words, the pixel circuit 11 includes a drive TFT 111, a switching TFT 112, a sampling TFT 115, an organic EL element 17, and a retention volume C111. The pixel circuit 11 having such a structure is disposed at the intersection of the data line DTL-1 and the scanning lines WSL-1 and DSL-1. The data line DTL-1 is connected to the drain of the sampling TFT 115, the scanning line WSL-1 is connected to the gate of the sampling TFT 115, and the other scanning line DSL-1 is connected to the gate of the switching TFT 112.

The drive TFT 111, the switching TFT 112, and the organic EL element 17 are serially connected between the power-supply voltage Vcc and the ground voltage GND. More specifically, the source of the drive TFT 111 is connected to the power-supply voltage Vcc, whereas the cathode of the organic EL element (light-emitting element) 17 is connected to the ground voltage GND. Since, in general, the organic EL element 17 is rectified, the organic EL element 17 is represented by a diode symbol. The sampling TFT 115 and the retention volume C111 are connected to the gate of the drive TFT 111. The voltage between the gate and the source of the drive TFT 111 is represented by the characters Vgs.

The operation of the pixel circuit 11 will be described now. First, selecting the scanning line WSL-1 (here the level is low) and applying a signal to the data line DTL-1 causes electricity to be applied to the sampling TFT 115 and the signal to be written in the retention volume C111. The signal voltage written in the retention volume C111 is the gate voltage of the drive TFT 111. Subsequently, not selecting the scanning line WSL-1 (here the level is high) causes the data line DTL-1 and the drive TFT 111 to be electrically disconnected. However, the gate voltage Vgs of the drive TFT 111 is stably maintained by the retention volume C111. Subsequently, selecting the other scanning line DSL-1 (here the level is low) causes electricity to be applied to the switching TFT 112 and a driving current to flow through the drive TFT 111, the switching TFT 112, and the light-emitting element 17 in the direction from the power-supply voltage Vcc to the ground voltage GND. Not selecting the other scanning line DSL-1 causes the switching TFT 112 to turn off and the driving current to stop flowing. The switching TFT 112 is provided to control the light emission time of the light-emitting element 17.

The values of the electrical current flowing through the drive TFT 111 and the light-emitting element 17 correspond to the voltage Vgs between the gate and the source of the drive TFT 111. Accordingly, the light-emitting element 17 continues to illuminate at a luminance corresponding to the current value. As described above, the operation of selecting the scanning line WSL-1 and transmitting the signal applied to the data line DTL-1 to the inside of the pixel circuit 11 is referred to as "writing in." Once the signal is written in, the light-emitting element continues to illuminate at a predetermined luminance while the drive TFT 112 is turned on until another signal is written in.

It should be understood by those skilled in the art that various modifications, combinations, subcombinations and alterations may occur depending on design requirements and other factors insofar as they are within the scope of the appended claims or the equivalents thereof.

What is claimed is:

1. A display apparatus comprising:

a pixel array including a plurality of pixels of light-emitting elements constituting a screen, the pixel array being configured to display each frame of an image on the screen by emitting light having a luminance in accordance with the level of an image signal and to continuously emit light from the screen within each frame for an amount of time specified by a duty ratio;

a life control unit configured to extend the life of the light-emitting elements by simultaneously adjusting the maximum permissible level of the image signal and the duty ratio, the life control unit including an average luminance calculating circuit and a duty ratio and maximum permissible luminance level calculating circuit;

a signal output unit for driving the screen to display an image by outputting an image signal adjusted within the maximum permissible level to the pixel array;

a duty ratio transmission unit for enabling the screen to emit light for an amount of time specified by transmitting an adjusted duty ratio to the pixel array; and a first gate driver for driving a duty signal to the pixels in the pixel array; and a second gate driver for driving a write-in signal to the pixels in the pixel array;

wherein the life control unit detects the average luminance of the image from the input image signal, and wherein the duty ratio specifying the light emission time per frame and the maximum permissible level of the image signal are reduced in inverse proportion to changes in the detected average luminance.

2. The display apparatus according to claim 1, wherein the life control unit automatically adjusts the maximum permissible level and duty ratio in accordance with the input image in real time.

3. The display apparatus of claim 1, wherein the maximum permissible level of luminance for the image signal traverses the range of 70 to 100 percent between the luminance levels of 200 to 600 nits, and the duty ratio traverses the range of 50 to 75 percent between the luminance levels of 200 to 600 nits.

4. The display apparatus of claim 1, wherein the average luminance calculating circuit detects the average luminance of the image from the input image signal and provides average luminance data to the duty ratio and maximum permissible luminance level calculating circuit, and the duty ratio and maximum permissible luminance level calculating circuit generates a duty signal and a maximum output level signal based on the input calculated average luminance.

5. The display apparatus of claim 1, wherein the second gate driver drives the write-in of data into the pixels in the pixel array in advance of the duty driving.

6. The display apparatus of claim 1, wherein each pixel in the pixel array includes a switching TFT connected to and driven by an output signal from the first gate driver.

7. The display apparatus of claim 1, wherein each pixel in the pixel array includes a switching TFT connected to and driven by a duty signal from the first gate driver; and a sampling TFT connected to and driven by a write signal from the second gate driver.

8. The display apparatus of claim 7, wherein each pixel is connected to a data signal, the duty signal, and the write signal, and the data signal is connected to the drain of the sampling TFT, the write signal is connected to the gate of the sampling TFT, and the duty signal is connected to the gate of the switching TFT.

9. A method for driving a display apparatus, the display apparatus having a screen comprised of a plurality of pixels of light-emitting elements, the method comprising the steps of:

displaying each frame of an adjusted image signal on the screen by emitting light from the plurality of light-emitting elements, the emitted light for each frame corresponding to a luminance level indicated by the adjusted image signal for an amount of time specified by a duty ratio;

extending the life of a plurality of pixels of light-emitting elements on said display by detecting the average luminance of an image from an input image signal at an average luminance calculating circuit within a life control unit, simultaneously adjusting a maximum permissible level of luminance of said input image signal to produce the adjusted image signal and adjusting the duty ratio based on said input image signal at a duty ratio and maximum permissible luminance level calculating circuit within the life control unit; and outputting said adjusted image signal from the life control unit, said adjusted image signal including the adjusted maximum permissible level of luminance for the plurality of pixels and an adjusted duty ratio for the plurality of pixels;

driving a duty signal to the pixels in the pixel array using a first gate driver; and driving a write-in signal to the pixels in the pixel array using a second gate driver;

wherein adjusting a maximum permissible level of luminance and adjusting the duty ratio includes adjusting the duty ratio specifying the light emission time per frame and the maximum permissible level of the input image signal in inverse proportion to changes in the detected average luminance.

10. The method for driving a display apparatus of claim 9, wherein the maximum permissible level of luminance for the image signal traverses the range of 70 to 100 percent between the luminance levels of 200 to 600 nits, and the duty ratio traverses the range of 50 to 75 percent between the luminance levels of 200 to 600 nits.

11. The method for driving a display apparatus of claim 9, wherein extending the life of a plurality of pixels of light-emitting elements further includes:

receiving the input image signal at the average luminance calculating circuit;

providing detected average luminance data to the duty ratio and maximum permissible luminance level calculating circuit;

and generating a duty signal and a maximum output level signal at the duty ratio and maximum permissible luminance level calculating circuit, at the duty ratio and maximum permissible luminance level calculating circuit.

12. A display apparatus comprising:

a pixel array including a screen, the screen comprised of a plurality of pixels of light-emitting elements, the pixel array configured to display each frame of an image on the screen by emitting light having a luminance in accordance with an adjusted image signal for an amount of time specified by an adjusted duty ratio;

a life control unit, including an average luminance calculating circuit and a duty ratio and luminance level calculating circuit, the life control unit being configured to extend the life of the light-emitting elements by adjusting a duty ratio and image signal based on a determined permissible luminance level to produce the adjusted image signal;

a signal output unit for driving the screen to display an image by outputting the adjusted image signal to the pixel array;

a duty ratio transmission unit for transmitting the adjusted duty ratio to the pixel array; and a first gate driver for driving a duty signal to the pixels in the pixel array; and a second gate driver for driving a write-in signal data into the pixels in the pixel array.

13. The display apparatus of claim 12, wherein the second gate driver drives the write-in signal to the pixels in the pixel array in advance of the duty signal from the first gate driver.

14. The display apparatus of claim 12, wherein each pixel in the pixel array includes a switching TFT connected to and driven by the duty signal from the first gate driver.

15. The display apparatus of claim 12, wherein each pixel in the pixel array includes a switching TFT connected to and driven by the duty signal from the first gate driver; and a sampling TFT connected to and driven by the write-in signal from the second gate driver.

16. The display apparatus of claim 15, wherein each pixel is connected to a data signal, the duty signal, and the write signal, and the data signal is connected to the drain of the sampling TFT, the write-in signal is connected to the gate of the sampling TFT, and the duty signal is connected to the gate of the switching TFT.

* * * * *